US011715907B2

(12) United States Patent
Chen et al.

(10) Patent No.: US 11,715,907 B2
(45) Date of Patent: Aug. 1, 2023

(54) ELECTRICAL CONNECTOR WITH FOOL-PROOF FUNCTION

(71) Applicant: Dongguan Luxshare Technologies Co., Ltd, Dongguan (CN)

(72) Inventors: Hongji Chen, Dongguan (CN); Rongzhe Guo, Dongguan (CN)

(73) Assignee: Dongguan Luxshare Technologies Co., Ltd, Dongguan (CN)

( * ) Notice: Subject to any disclaimer, the term of this patent is extended or adjusted under 35 U.S.C. 154(b) by 8 days.

(21) Appl. No.: 17/367,910

(22) Filed: Jul. 6, 2021

(65) Prior Publication Data

US 2022/0077632 A1 Mar. 10, 2022

(30) Foreign Application Priority Data

Sep. 4, 2020 (CN) ..... 202010925490.1

(51) Int. Cl.
*H01R 13/64* (2006.01)
*H01R 13/6581* (2011.01)
*H01R 24/60* (2011.01)

(52) U.S. Cl.
CPC ..... *H01R 13/64* (2013.01); *H01R 13/6581* (2013.01); *H01R 24/60* (2013.01)

(58) Field of Classification Search
None
See application file for complete search history.

(56) References Cited

U.S. PATENT DOCUMENTS 5,013,262 A * 5/1991 Shibano ..... H01R 13/658 439/353
6,808,428 B1 † 10/2004 Korsunsky
9,742,132 B1 * 8/2017 Hsueh ..... H01R 24/60
11,289,850 B2 * 3/2022 Faith ..... H01R 13/506
2010/0062650 A1 * 3/2010 Nakamura ..... H01R 13/64 439/65

(Continued)

FOREIGN PATENT DOCUMENTS

CN 205335540 U 6/2016
CN 206787805 U 12/2017

(Continued)

*Primary Examiner* — Oscar C Jimenez
(74) *Attorney, Agent, or Firm* — Birch, Stewart, Kolasch & Birch, LLP

(57) ABSTRACT

The present disclosure discloses an electrical connector including an insulating body, a number of conductive terminals and a shielding shell. The insulating body includes a mating surface and a slot. Each conductive terminal includes a contact portion extending into the slot. A receiving groove for receiving a part of a mating connector is formed between the shielding shell and the insulating body. The receiving groove is located outside the slot. The electrical connector further includes a first outer surface and a fool-proof protrusion protruding beyond the first outer surface in a direction perpendicular to an insertion direction of the mating connector. The first outer surface and the receiving groove are located on two opposite sides of the slot, respectively. The fool-proof protrusion is adapted to prevent the mating connector from being inserted into the electrical connector at a wrong angle.

15 Claims, 13 Drawing Sheets

(56) References Cited

U.S. PATENT DOCUMENTS

| | | | | |
|---|---|---|---|---|
| 2012/0322316 | A1* | 12/2012 | Chen | H01R 13/64 439/668 |
| 2017/0256899 | A1* | 9/2017 | Mitchell | H01R 13/53 |
| 2019/0173232 | A1† | 6/2019 | Lu | |
| 2019/0267760 | A1 | 8/2019 | Chen | |
| 2020/0266584 | A1* | 8/2020 | Lu | H01R 12/75 |

FOREIGN PATENT DOCUMENTS

| | | | | |
|---|---|---|---|---|
| CN | 207398496 | U | | 5/2018 |
| CN | 207572652 | | † | 7/2018 |
| CN | 207753259 | U | | 8/2018 |
| CN | 109301607 | A | | 2/2019 |
| CN | 209561681 | U | | 10/2019 |
| TW | M249332 | U | | 5/2003 |
| TW | I556520 | | † | 11/2016 |
| TW | M613621 | U | | 6/2021 |
| WO | 2019/084717 | | † | 5/2019 |

* cited by examiner
† cited by third party

ELECTRICAL CONNECTOR WITH FOOL-PROOF FUNCTION

CROSS-REFERENCE TO RELATED APPLICATION

This patent application claims priority of a Chinese Patent Application No. 202010925490.1, filed on Sep. 4, 2020 and titled "ELECTRICAL CONNECTOR", the entire content of which is incorporated herein by reference.

TECHNICAL FIELD

The present disclosure relates to an electrical connector which belongs to a technical field of connectors.

BACKGROUND

An existing electrical connector assembly usually includes a plug connector (a male connector) and a socket connector (a female connector) that are mated with each other. It is known that data and/or power transmission can only be realized when the plug connector and the socket connector are correctly mated. If the plug connector and the receptacle connector are mated at a wrong angle (for example, the plug connector is flipped 180 degrees and inserted backwardly into the socket connector), firstly the transmission function cannot be realized, and secondly terminals are easily to be damaged. Therefore, it is necessary to design an electrical connector with fool-proof function in order to protect the terminals from being damaged due to incorrect insertion of a mating connector.

SUMMARY

An object of the present disclosure is to provide an electrical connector with a fool-proof function.

In order to achieve the above object, the present disclosure adopts the following technical solution: an electrical connector including: an insulating body comprising a mating surface and a slot extending through the mating surface, the slot being adapted to receive a part of a mating connector; a plurality of conductive terminals, each conductive terminal comprising a contact portion extending into the slot; and a shielding shell shielded on the insulating body, a receiving groove for receiving a part of the mating connector being formed between the shielding shell and the insulating body, the receiving groove being located outside the slot; wherein the electrical connector further comprises a first outer surface and a fool-proof protrusion protruding beyond the first outer surface in a direction perpendicular to an insertion direction of the mating connector; the first outer surface and the receiving groove are located on two opposite sides of the slot, respectively; and the fool-proof protrusion is adapted to prevent the mating connector from being inserted into the electrical connector at a wrong angle.

In order to achieve the above object, the present disclosure adopts the following technical solution: an electrical connector including: an insulating body comprising a mating surface and a slot extending through the mating surface; a plurality of conductive terminals, each conductive terminal comprising a contact portion extending into the slot for mating with a mating connector; and a shielding shell enclosing the insulating body, a receiving groove for receiving a part of the mating connector being formed between the shielding shell and the insulating body, the receiving groove being located outside the slot; wherein the electrical connector further comprises a first outer surface and a fool-proof protrusion protruding beyond the first outer surface in a direction perpendicular to an insertion direction of the mating connector; the first outer surface and the receiving groove are located on opposite sides of the slot, respectively; the fool-proof protrusion is of a cantilevered configuration and comprises a horizontal portion located at a free end of the fool-proof protrusion, and the horizontal portion is adapted to prevent the mating connector from being inserted into the electrical connector at a wrong angle.

Compared with the prior art, the present disclosure provides a fool-proof protrusion protruding beyond the first outer surface, and the fool-proof protrusion is used to prevent the mating connector from being inserted into the electrical connector at a wrong angle, thereby protecting the electrical connector of the present disclosure.

DETAILED DESCRIPTION

Figure 1:
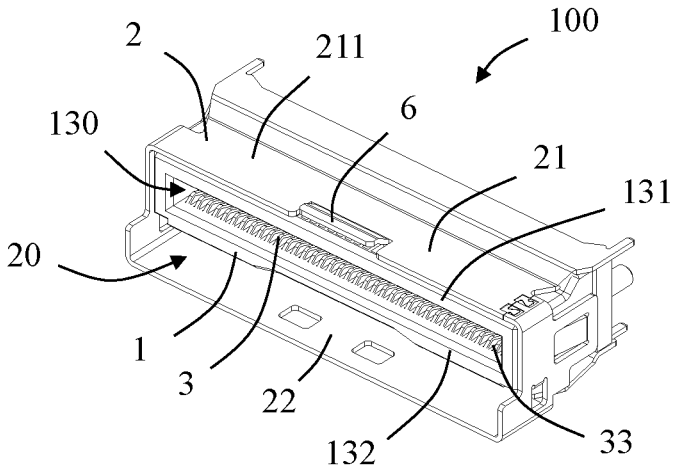
FIG. 1 is a perspective schematic view of an electrical connector in accordance with a first embodiment of the present disclosure.
Figure 2:
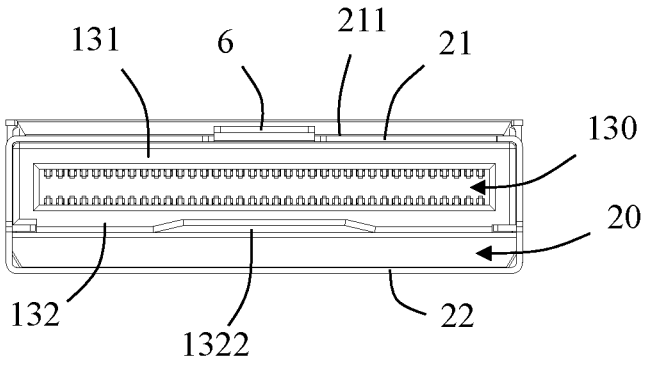
FIG. 2 is a front view of FIG. 1.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Referring to FIGS. 1 to 4, the present disclosure discloses an electrical connector 100 for being mounted to a circuit board (not shown). The electrical connector 100 can be applied to devices such as switches, servers, data centers, etc., to transmit data. The electrical connector 100 includes an insulating body 1, a shielding shell 2 shielded on the insulating body 1, and a plurality of conductive terminals 3 extending into the insulating body 1.

Figure 3:
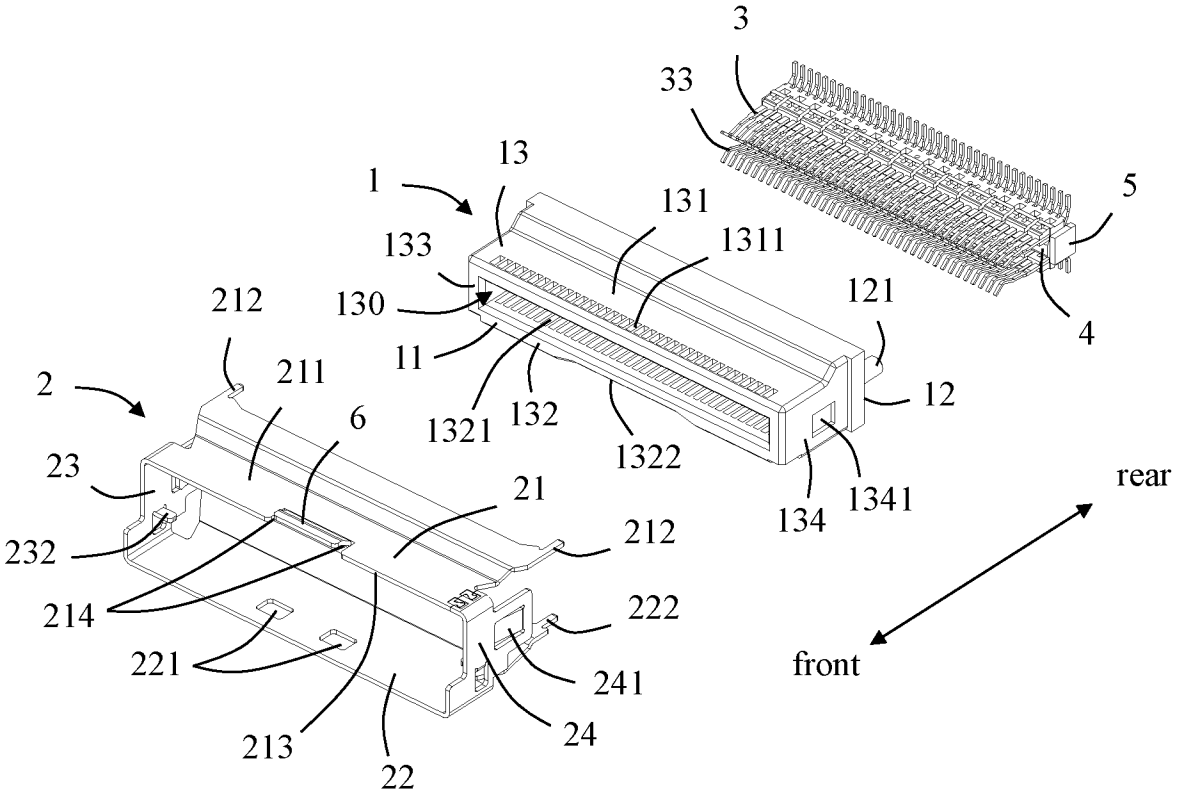
FIG. 3 is a partially exploded perspective view of FIG. 1.
Figure 4:
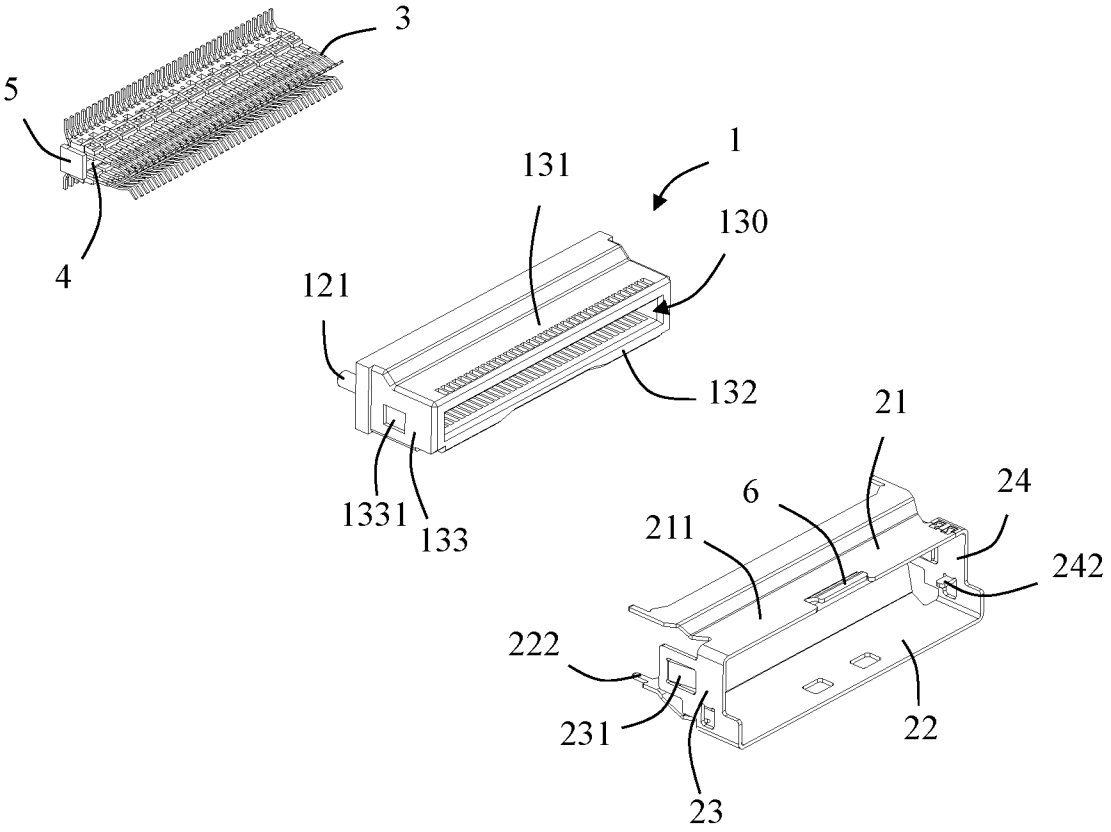
FIG. 4 is a partially exploded perspective view of FIG. 3 from another angle.

Referring to FIGS. 3 and 4, the insulating body 1 includes a mating surface 11, a mounting surface 12 opposite to the mating surface 11, and a frame portion 13. The frame portion 13 includes a first wall portion 131, a second wall portion 132 opposite to the first wall portion 131, a third wall portion 133 connecting one side of the first wall portion 131 and one side of the second wall portion 132, and a fourth wall portion 134 connecting the other side of the first wall portion 131 and the other side of the second wall portion 132. The first wall portion 131, the second wall portion 132, the third wall portion 133 and the fourth wall portion 134 together form a slot 130 for receiving a part of the mating connector 200 (referring to FIG. 9). The slot 130 extends through the mating surface 11. The first wall portion 131 defines a plurality of first terminal grooves 1311. The second wall portion 132 defines a plurality of second terminal grooves 1321. The insulating body 1 includes a plurality of positioning protrusions 121 protruding backwardly beyond the mounting surface 12 for mounting the electrical connector 100 to the circuit board. The third wall portion 133 defines a plurality of first grooves 1331. The fourth wall portion 134 defines a plurality of second grooves 1341. A bottom surface of the second wall portion 132 further includes a recessed portion 1322 recessed toward the first wall portion 131 for mating with the mating connector 200.

Figure 5:
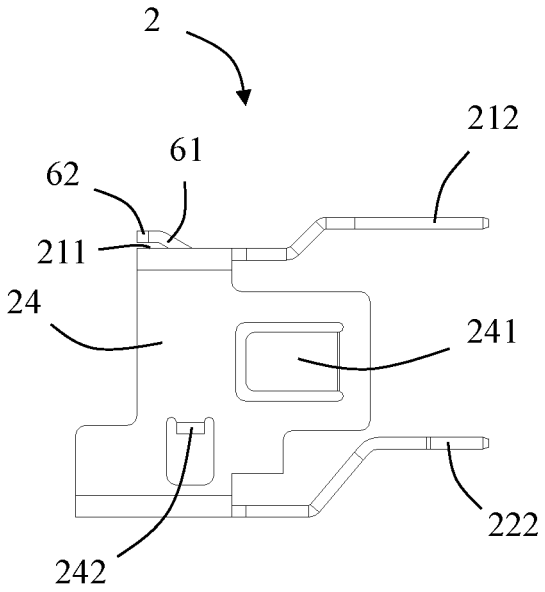
FIG. 5 is a right side view of a shielding shell in FIG. 3.

Referring to FIGS. 3 to 5, in the illustrated embodiment of the present disclosure, the shielding shell 2 is made of a metal material. The shielding shell 2 includes a first shell portion 21, a second shell portion 22 opposite to the first shell portion 21, a third shell portion 23 connecting one side of the first shell portion 21 and one side of the second shell portion 22, and a fourth shell portion 24 connecting the other side of the first shell portion 21 and the other side of the second shell portion 22. The first shell portion 21 abuts on the first wall portion 131. The first shell portion 21 includes a first outer surface 211 (for example, a top surface). The first shell portion 21 further includes a plurality of first mounting feet 212 extending backwardly beyond the mounting surface 12. The first mounting feet 212 is used to mount the electrical connector 100 to the circuit board. The second shell portion 22 extends forwardly beyond the first shell portion 21. The second shell portion 22 and the second wall portion 132 are separated by a certain distance, thereby forming a receiving groove 20 between the second shell portion 22 and the second wall portion 132 (referring to FIGS. 1 and 2). The receiving groove 20 is adapted to receive a part of the mating connector 200. The second shell portion 22 further includes at least one locking hole 221 in communication with the receiving groove 20. The locking hole 221 is adapted for locking with a locking protrusion of the mating connector 200 so as to ensure that the electrical connector 100 and the mating connector 200 are reliably connected together and prevent them from being improperly separated. The receiving groove 20 is located outside the slot 130. The receiving groove 20 is independent of the slot 130. In the illustrated embodiment of the present disclosure, the receiving groove 20 and the slot 130 are separated by the second wall portion 132.

The first outer surface 211 and the receiving groove 20 are located on two sides (for example, an upper side and a lower side) of the slot 130, respectively. The second shell portion 22 includes a plurality of second mounting feet 222 extending backwardly beyond the mounting surface 12. The second mounting feet 222 are adapted to mount the electrical connector 100 to the circuit board. In addition, the third shell portion 23 includes a first clamping piece 231 which is clamped into the first groove 1331, and the fourth shell portion 24 includes a second clamping piece 241 which is clamped into the second groove 1341, so that the shielding shell 2 is prevented from being separated from the insulating body 1. In addition, the third shell portion 23 and/or the fourth shell portion 24 also includes protrusions 232, 242 which are engaged with the insulating body 1 to further prevent the shielding shell 2 from being separated from the insulating body 1.

Figure 6:
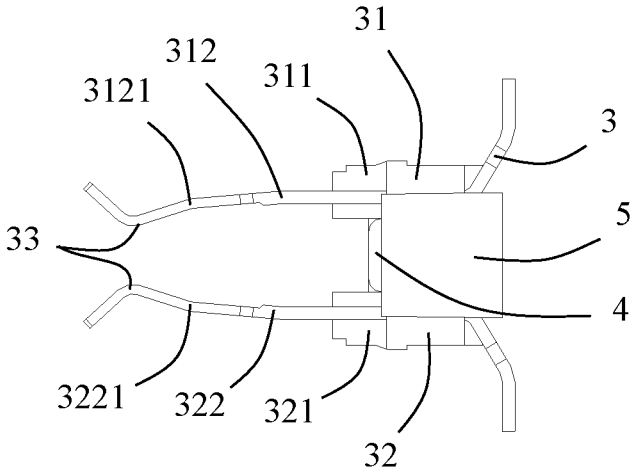
FIG. 6 is a right side view of a first terminal module, a second terminal module, a grounding member and a positioning block in FIG. 3 when they are combined together.
Figure 7:
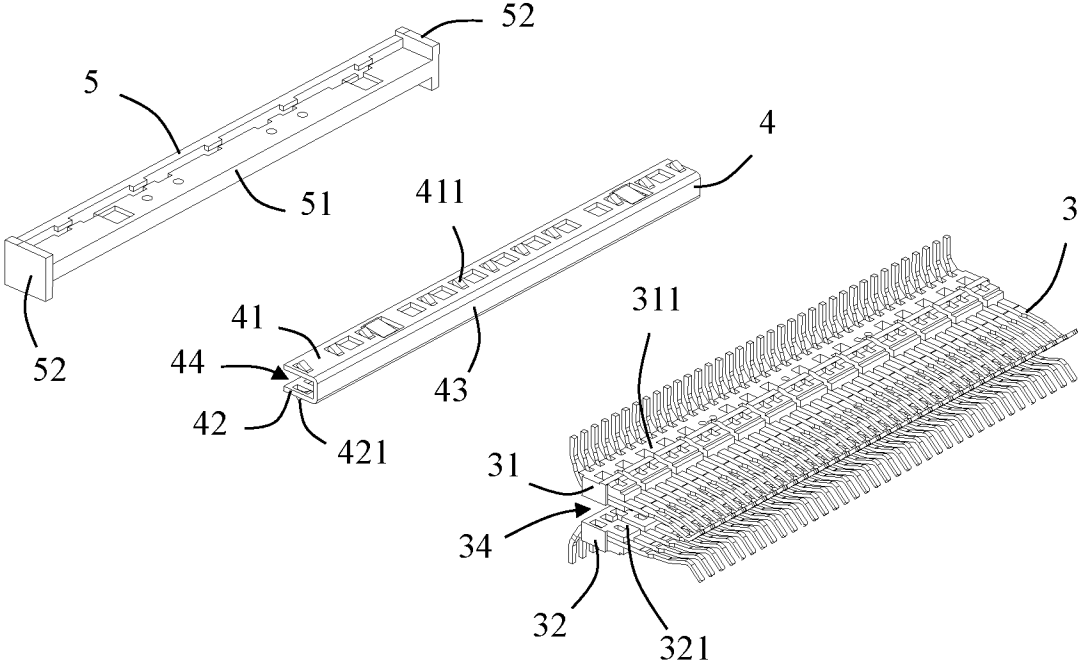
FIG. 7 is a perspective exploded view of the first terminal module, the second terminal module, the grounding member and the positioning block in FIG. 4.
Figure 8:
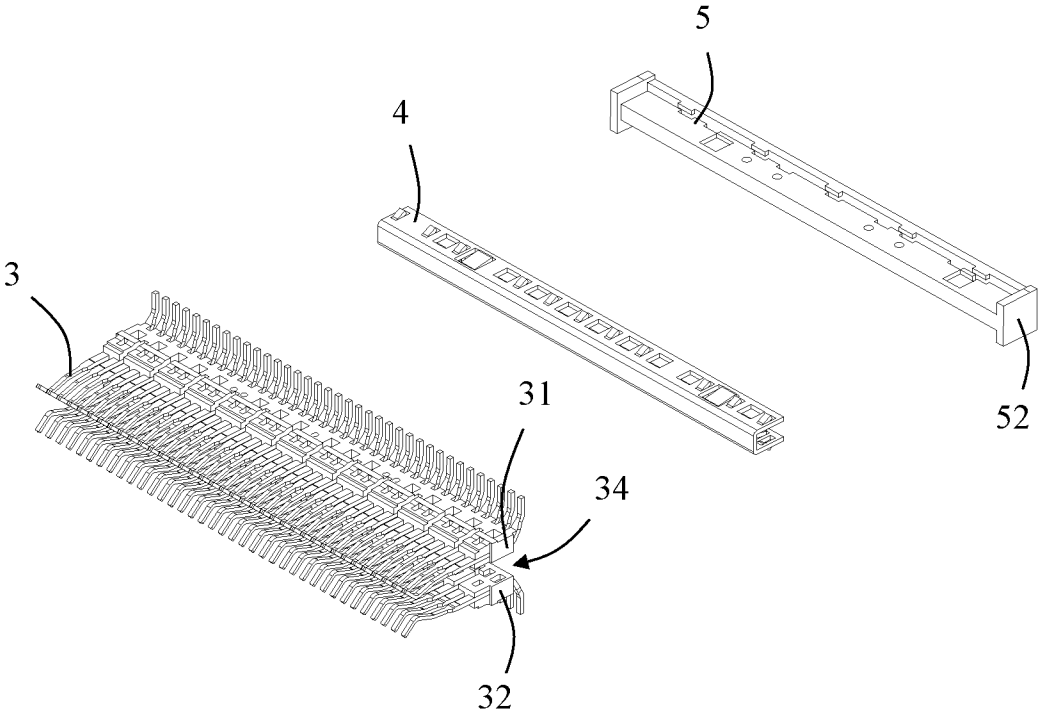
FIG. 8 is a perspective exploded view of FIG. 7 from another angle.

Referring to FIGS. 6 to 8, in the illustrated embodiment of the present disclosure, the electrical connector 100 includes a first terminal module 31 and a second terminal module 32 which are assembled to the insulating housing 1. The first terminal module 31 includes a first insulating block 311 and a plurality of first conductive terminals 312 fixed to the first insulating block 311. The second terminal module 32 includes a second insulating block 321 and a plurality of second conductive terminals 322 fixed to the second insulating block 321. The first conductive terminals 312 include a plurality of first elastic arms 3121 corresponding to the first terminal grooves 1311 and protruding beyond the first wall portion 131. The second conductive terminals 322 include a plurality of second elastic arms 3221 corresponding to the second terminal grooves 1321 and protruding beyond the second wall portion 132. Each of the first elastic arms 3121 and the second elastic arms 3221 extends into the slot 130, and includes a contact portion 33 for mating with the mating connector 200.

Referring to FIGS. 6 to 8, a spacing groove 34 is formed between the first insulating block 311 and the second insulating block 321. The electrical connector 100 further includes a grounding member 4 installed in the spacing groove 34 and a positioning block 5 installed in the grounding member 4. In the illustrated embodiment of the present disclosure, the plurality of conductive terminals 3 include a plurality of signal terminals and a plurality of ground terminals. A cross section of the grounding member 4 is U-shaped, and includes a first extension wall 41, a second extension wall 42 opposite to the first extension wall 41, and a connecting wall 43 connecting the first extension wall 41 and the second extension wall 42. The first extension wall 41 and/or the second extension wall 42 are in contact with the ground terminals. In addition, the first extension wall 41 and the second extension wall 42 include protruding strips 411, 421 to press against the first insulating block 311 and the second insulating block 321, respectively, in order to increase the holding force. In addition, the grounding member 4 also includes a positioning slot 44 which opens backwardly. In the illustrated embodiment of the present disclosure, the positioning block 5 includes a main body portion 51 clamped in the positioning slot 44 and side portions 52 located at two ends of the main body portion 51. The side portions 52 extend beyond the grounding member 4 along a left-right direction.

Figure 9:
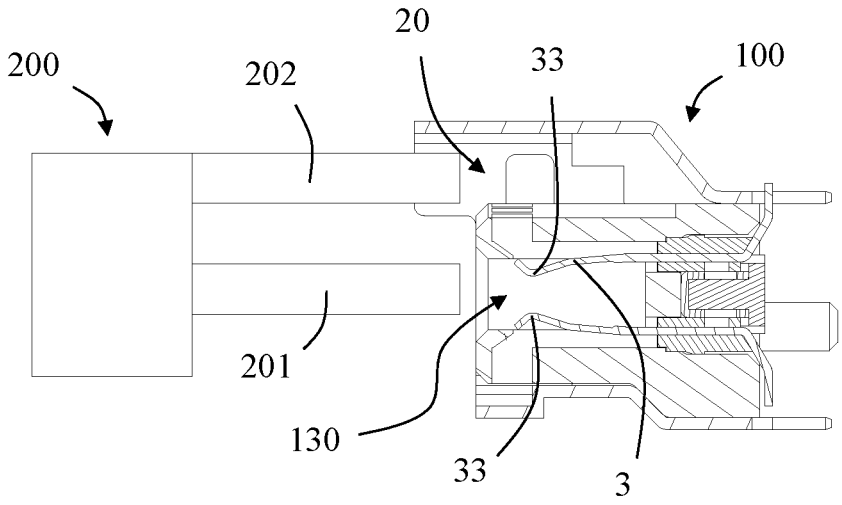
FIG. 9 is a schematic view when a mating connector is inserted into the electrical connector of the present disclosure at a correct angle (for example, a normal insertion)
Figure 10:
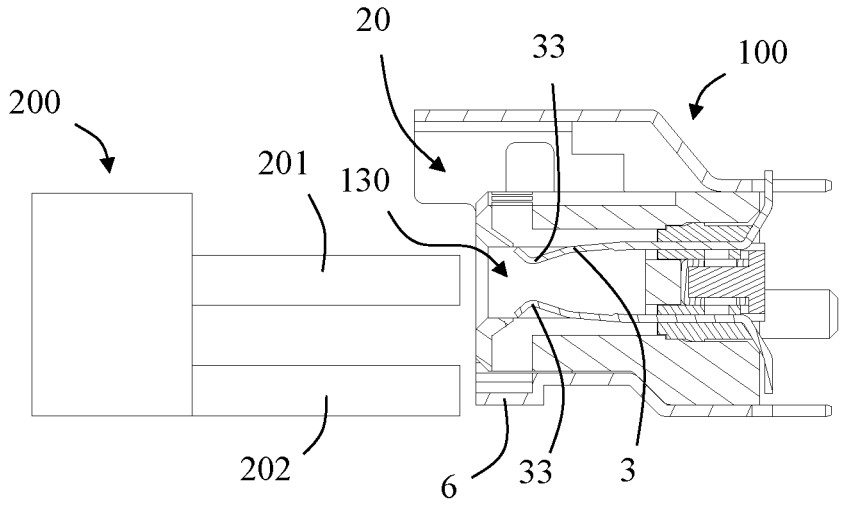
FIG. 10 is a schematic view when the mating connector is inserted into the electrical connector of the present disclosure at a wrong angle (for example, a reverse insertion)

In the illustrated embodiment of the present disclosure, the first outer surface 211 of the electrical connector 100 is disposed on the first shell portion 21 of the shielding shell 2. Of course, in other embodiments, the first outer surface 211 of the electrical connector 100 may also be disposed on the insulating body 1 (for example, a top surface of the insulating body 1). The electrical connector 100 further includes a fool-proof protrusion 6 protruding beyond the first outer surface 211 in a direction (for example, a vertical direction) perpendicular to an insertion direction of the mating connector 200. The fool-proof protrusion 6 is adapted to prevent the mating connector 200 from being inserted into the electrical connector 100 at a wrong angle. Referring to FIGS. 9 and 10, in the illustrated embodiment of the present disclosure, the mating connector 200 includes a tongue plate 201 and a positioning protrusion 202. The tongue plate 201 is parallel to the positioning protrusion 202 and located on one side (for example, an upper side or a lower side) of the positioning protrusion 202. A plurality of conductive pads (not shown) for mating with the contact portions 33 of the electrical connector 100 are provided on the tongue plate 201. Referring to FIG. 9, when the mating connector 200 is inserted into the electrical connector 100 at a correct angle, the tongue plate 201 is inserted into the slot 130, the conductive pads are in contact with the conductive terminals, and the positioning protrusion 202 is inserted into the receiving groove 20. Referring to FIG. 10, when the mating connector 200 is inserted into the electrical connector 100 at a wrong angle (for example, the mating connector 200 is turned over by 180 degrees), the tongue plate 201 corresponds to a place where the slot 130 is located, the positioning protrusion 202 is located on a side of the first shell portion 21 away from the slot 130. Under this condition, the fool-proof protrusion 6 is located on an insertion path of the positioning protrusion 202, so that the positioning protrusion 202 can prevent the mating connector 200 from being inserted into the electrical connector 100 at the wrong angle. Preferably, the fool-proof protrusion 6 is disposed adjacent to the mating surface 11, so that the mating connector 200 can be prevented as early as possible when it is inserted at the wrong angle.

Referring to FIGS. 1 to 5, in a first embodiment of the present disclosure, the fool-proof protrusion 6 and the shielding shell 2 are integrally formed. For example, the fool-proof protrusion 6 is integrally stamped from the first shell portion 21 to save cost. Specifically, the first shell portion 21 includes a first end surface 213 adjacent to the mating surface 11. The first shell portion 21 defines a pair of slits 214 corresponding to the fool-proof protrusion 6. The slits 214 extend through the first end surface 213. Referring to FIG. 5, in the illustrated embodiment of the present disclosure, the fool-proof protrusion 6 is of a cantilevered configuration, and includes an inclined portion 61 connected to the first shell portion 21 and a horizontal portion 62 extending forwardly from the inclined portion 61. The horizontal portion 62 is located at a free end of the cantilever. With this arrangement, when the mating connector 200 is inserted into the electrical connector 100 at a wrong angle, the horizontal portion 62 only generates a horizontal force, thereby reducing the risk of failure of the fool-proof protrusion 6 being bent by the mating connector 200. In the first embodiment of the present disclosure, the number of the fool-proof protrusions 6 is one and is located in the middle of the first shell portion 21.

Figure 11:
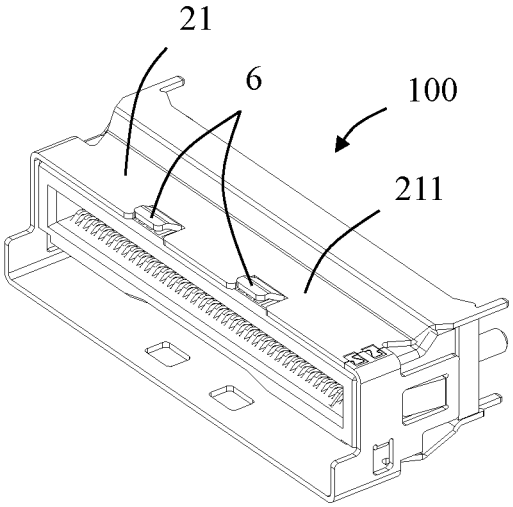
FIG. 11 is a perspective schematic view of the electrical connector in accordance with a second embodiment of the present disclosure.
Figure 12:
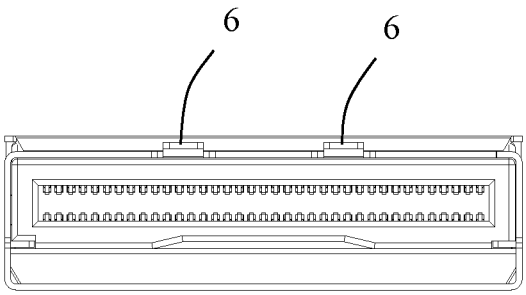
FIG. 12 is a front view of FIG. 11.

Referring to FIGS. 11 and 12, in a second embodiment of the present disclosure, the number of the fool-proof protrusions 6 is two and they are symmetrically arranged along a center line of the first shell portion 21.

Figure 13:
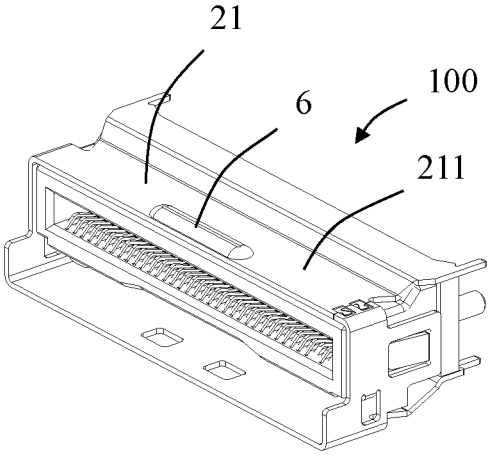
FIG. 13 is a perspective schematic view of the electrical connector in accordance with a third embodiment of the present disclosure.
Figure 14:
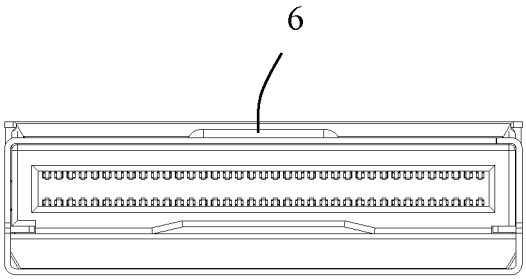
FIG. 14 is a front view of FIG. 13.

Referring to FIGS. 13 and 14, in a third embodiment of the present disclosure, there is one fool-proof protrusion 6 and it is formed by punching upwardly from the first shell portion 21. Front, back, left and right sides of the fool-proof protrusion 6 are connected to the first shell portion 21, that is, the fool-proof protrusion 6 is a bulge raising upwardly. The fool-proof protrusion 6 has an arc-shaped surface to reduce damage to the mating connector 200 when the mating connector 200 is inserted at a wrong angle. In the third embodiment of the present disclosure, the structural strength of the fool-proof protrusion 6 is relatively high.

Figure 15:
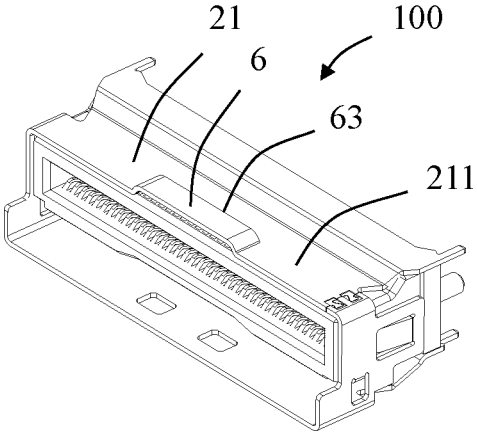
FIG. 15 is a perspective schematic view of the electrical connector in accordance with a fourth embodiment of the present disclosure.
Figure 16:
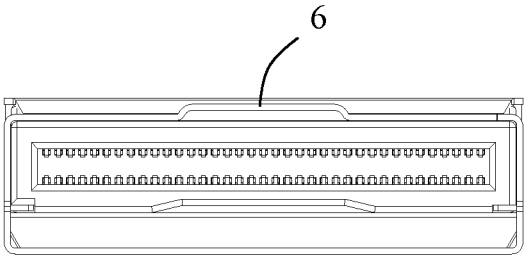
FIG. 16 is a front view of FIG. 15.

Referring to FIGS. 15 and 16, in a fourth embodiment of the present disclosure, there is one fool-proof protrusion 6 and it is formed by punching upwardly from the first shell portion 21. Both left and right ends of the fool-proof protrusion 6 are connected to the first shell portion 21. A rear end surface 63 of the fool-proof protrusion 6 is torn away from the first shell portion 21. This arrangement can improve the structural strength of the fool-proof protrusion 6 and prevent it from being damaged by the mating connector 200.

Figure 17:
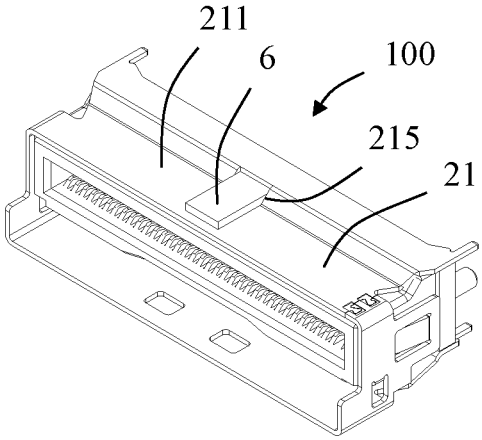
FIG. 17 is a perspective view of the electrical connector in accordance with a fifth embodiment of the present disclosure.
Figure 18:
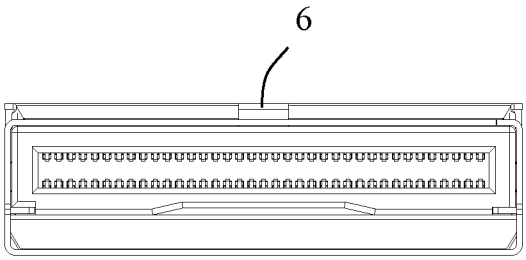
FIG. 18 is a front view of FIG. 17.

Referring to FIGS. 17 and 18, in a fifth embodiment of the present disclosure, the fool-proof protrusion 6 and the insulating body 1 are integrally formed. The first shell portion 21 defines an opening 215. The fool-proof protrusion 6 extends through the opening 215 to be located on the first outer surface 211.

Figure 19:
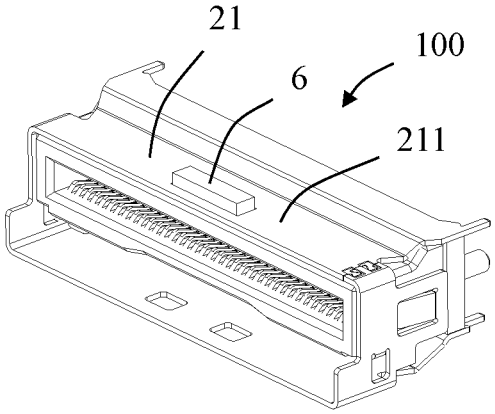
FIG. 19 is a perspective view of the electrical connector in accordance with a sixth embodiment of the present disclosure.
Figure 20:
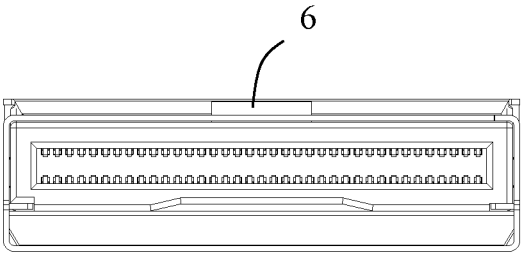
FIG. 20 is a front view of FIG. 19.

Referring to FIGS. 19 and 20, in a sixth embodiment of the present disclosure, the fool-proof protrusion 6 is provided separately from the first shell portion 21 and is fixed to the first shell portion 21. The fool-proof protrusion 6 can be fixed to the first shell portion 21 by various methods such as soldering, pasting, clamping and the like. The fool-proof protrusion 6 may be made of metal, plastic or other materials with certain hardness.

The above embodiments are only used to illustrate the present disclosure and not to limit the technical solutions described in the present disclosure. The understanding of this specification should be based on those skilled in the art. Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. An electrical connector, comprising:

an insulating body comprising a mating surface and a slot extending through the mating surface, the slot being adapted to receive a part of a mating connector;

a plurality of conductive terminals, each conductive terminal comprising a contact portion extending into the slot; and a shielding shell shielded on the insulating body, a receiving groove for receiving a part of the mating connector being formed between the shielding shell and the insulating body, the receiving groove being located outside the slot;

wherein the electrical connector further comprises a first outer surface and a fool-proof protrusion protruding beyond the first outer surface in a direction perpendicular to an insertion direction of the mating connector; the first outer surface and the receiving groove are located on opposite sides of the slot, respectively; and the fool-proof protrusion is located adjacent to the mating surface of the insulating body and configured to prevent the mating connector from being inserted into the electrical connector at a wrong angle when the mating connector is initially inserted into the electrical connector;

wherein the shielding shell comprises a first shell portion on which the first outer surface is formed; and wherein the fool-proof protrusion and the shielding shell are integrally formed;

wherein the shielding shell is made of a metal material, and the fool-proof protrusion is integrally stamped from the first shell portion; and wherein the first shell portion comprises a first end surface adjacent to the mating surface, the first shell portion comprises a pair of slits corresponding to the fool-proof protrusion, and the slits extend through the first end surface.

2. The electrical connector according to claim 1, wherein the shielding shell comprises a first shell portion on which the first outer surface is formed; and wherein the fool-proof protrusion and the insulating body are integrally formed.

3. The electrical connector according to claim 2, wherein the first shell portion defines an opening, and the fool-proof protrusion extends through the opening to be located on the first outer surface.

4. The electrical connector according to claim 1, wherein the shielding shell comprises a first shell portion on which the first outer surface is formed; and wherein the fool-proof protrusion is arranged separately from the first shell portion and fixed to the first shell portion.

5. The electrical connector according to claim 1, wherein the insulating body comprises a first wall portion and a second wall portion opposite to the first wall portion, the slot is located between the first wall portion and the second wall portion;

the shielding shell comprises a second shell portion opposite to the first shell portion, the first shell portion shields the first wall portion, the second shell portion shields the second wall portion, the receiving groove is located between the second wall portion and the second shell portion, the second shell portion defines at least one locking hole in communication with the receiving groove, and the at least one locking hole is adapted to lock with the mating connector.

6. The electrical connector according to claim 5, wherein the electrical connector comprises a first terminal module and a second terminal module which are assembled to the insulating body, the first terminal module comprises a first insulating block and a plurality of first conductive terminals fixed to the first insulating block, the second terminal module comprises a second insulating block and a plurality of second conductive terminals fixed to the second insulating block, the first conductive terminals comprise a plurality of first elastic arms protruding beyond the first wall portion and extending into the slot, and the second conductive terminals comprise a plurality of second elastic arms protruding beyond the second wall portion and extending into the slot.

7. The electrical connector according to claim 6, wherein a spacing groove is formed between the first insulating block and the second insulating block; and wherein the electrical connector further comprises a grounding member installed in the spacing groove.

8. The electrical connector according to claim 7, wherein the grounding member has a U-shaped cross-section and defines a positioning slot; and wherein the electrical connector further comprises a positioning block clamped in the positioning slot.

9. An electrical connector, comprising:

an insulating body comprising a mating surface and a slot extending through the mating surface;

a plurality of conductive terminals, each conductive terminal comprising a contact portion extending into the slot for mating with a mating connector; and a shielding shell enclosing the insulating body, a receiving groove for receiving a part of the mating connector being formed between the shielding shell and the insulating body, the receiving groove being located outside the slot;

wherein the electrical connector further comprises a first outer surface and a fool-proof protrusion protruding beyond the first outer surface in a direction perpendicular to an insertion direction of the mating connector; the first outer surface and the receiving groove are located on opposite sides of the slot, respectively; the fool-proof protrusion is of a cantilevered configuration and comprises a horizontal portion located at a free end of the fool-proof protrusion, and the horizontal portion is located adjacent to the mating surface of the insulating body and configured to prevent the mating connector from being inserted into the electrical connector at a wrong angle when the mating connector is initially inserted into the electrical connector;

wherein the shielding shell comprises a first shell portion on which the first outer surface is formed; and wherein the fool-proof protrusion comprises an inclined portion connected to the first shell portion, and the horizontal portion extends forwardly from the inclined portion.

10. The electrical connector according to claim 9, wherein the fool-proof protrusion and the shielding shell are integrally formed.

11. The electrical connector according to claim 10, wherein the shielding shell is made of a metal material, and the fool-proof protrusion is integrally stamped from the first shell portion.

12. The electrical connector according to claim 9, wherein the first shell portion comprises a first end surface adjacent to the mating surface, the first shell portion comprises a pair of slits corresponding to the fool-proof protrusion, and the slits extend through the first end surface.

13. The electrical connector according to claim 9, wherein the electrical connector comprises a first terminal module and a second terminal module which are assembled to the insulating body, the first terminal module comprises a first insulating block and a plurality of first conductive terminals fixed to the first insulating block, the second terminal module comprises a second insulating block and a plurality of second conductive terminals fixed to the second insulating block, the first conductive terminals comprise a plurality of first elastic arms extending into the slot, the second conductive terminals comprise a plurality of second elastic arms extending into the slot, the conductive terminals comprise the first conductive terminals and the second conductive terminals.

14. The electrical connector according to claim 13, wherein a spacing groove is formed between the first insulating block and the second insulating block; and wherein the electrical connector further comprises a grounding member installed in the spacing groove.

15. An electrical connector, comprising:

an insulating body comprising a mating surface and a slot extending through the mating surface;

a plurality of conductive terminals, each conductive terminal comprising a contact portion extending into the slot for mating with a mating connector; and a shielding shell enclosing the insulating body, a receiving groove configured to at least partially receive the mating connector being formed between the shielding shell and the insulating body, the receiving groove being located outside the slot;

wherein the electrical connector further comprises a first outer surface and a fool-proof protrusion protruding beyond the first outer surface in a direction perpendicular to an insertion direction of the mating connector; the fool-proof protrusion is located adjacent to the mating surface of the insulating body;

wherein the fool-proof protrusion is such configured that when the mating connector is inserted into the electrical connector along the insertion direction at a correct angle, the fool-proof protrusion allows insertion of the mating connector into the electrical connector; and when the mating connector is initially inserted into the electrical connector along the insertion direction at a wrong angle, the fool-proof protrusion prevents further insertion of the mating connector into the electrical connector; and wherein the shielding shell comprises a first shell portion on which the first outer surface is formed; and wherein the fool-proof protrusion is integrally stamped from the first shell portion.

* * * * *